US007867155B2

(12) United States Patent
Kerschbaumer et al.

(10) Patent No.: US 7,867,155 B2
(45) Date of Patent: Jan. 11, 2011

(54) EXPANDER ROLLER

(75) Inventors: Josef Kerschbaumer, Maria Laach (AT); Georg Gobec, Wiener Neustadt (AT); Norbert Gamsjaeger, Bad Fischau (AT); Benno Bader, Neunkirchen (AT); Thomas Gruber-Nadlinger, Langenrohr (AT)

(73) Assignee: Voith Patent GmbH, Heidenheim (DE)

( * ) Notice: Subject to any disclaimer, the term of this patent is extended or adjusted under 35 U.S.C. 154(b) by 185 days.

(21) Appl. No.: 12/050,694

(22) Filed: Mar. 18, 2008

(65) Prior Publication Data

US 2008/0203130 A1 Aug. 28, 2008

Related U.S. Application Data

(63) Continuation of application No. PCT/EP2006/064139, filed on Jul. 12, 2006.

(30) Foreign Application Priority Data

Sep. 20, 2005 (DE) ..... 10 2005 044 956

(51) Int. Cl.
*B21B 27/00* (2006.01)

(52) U.S. Cl. ..... 492/21; 492/1; 492/2; 492/6; 492/7

(58) Field of Classification Search ..... 492/1, 492/2, 6, 7, 26, 43, 44, 16, 20, 21
See application file for complete search history.

(56) References Cited

U.S. PATENT DOCUMENTS 1,868,860 A 7/1932 Reis
3,672,018 A 6/1972 Junk et al.
3,676,909 A * 7/1972 Tuomaala ..... 492/6
3,728,767 A 4/1973 Shirai
3,729,788 A 5/1973 Tawa
4,372,205 A 2/1983 Pflaum
4,477,954 A * 10/1984 Molinatto ..... 492/7

(Continued)

FOREIGN PATENT DOCUMENTS

DE 28 32 457 2/1980

(Continued)

OTHER PUBLICATIONS

International Search Report dated Dec. 6, 2006 for PCT/EP2006/064139 (2 pages).

*Primary Examiner*—David P Bryant
*Assistant Examiner*—Christopher Besler
(74) *Attorney, Agent, or Firm*—Taylor IP, P.C.

(57) ABSTRACT

A roller for a web-processing machine, the roller having a support core, which is braced in the region of both its ends via a respective bearing arrangement, and an outer covering, which in its axially central region is mounted in a radially fixed manner in relation to the support core and in the region of its two ends is braced in a radially displaceable manner in relation to the support core by a respective additional bearing arrangement, whereby the outer covering is displaceable in the region of its two ends respectively by an actuator arranged within the outer covering, the actuator being adjustable and including two inter-mounted eccentrics to which is assigned respectively one pivoting device, whereby the two pivoting devices are controllable such that the size of the resulting eccentricity and the position of the resulting eccentricity are adjustable preferably separately from each other.

49 Claims, 9 Drawing Sheets

U.S. PATENT DOCUMENTS

| | | | | |
|---|---|---|---|---|
| 4,487,122 | A | 12/1984 | George et al. | |
| 4,510,865 | A | 4/1985 | Molinatto | |
| 5,533,374 | A * | 7/1996 | Seto et al. | 72/247 |
| 6,336,398 | B1 | 1/2002 | Kayser et al. | |
| 6,468,194 | B2 | 10/2002 | Wojtkowski, Jr. et al. | |
| 2005/0012253 | A1 | 1/2005 | Wurm et al. | |
| 2008/0205867 | A1 | 8/2008 | Gruber-Nadlinger et al. | |

FOREIGN PATENT DOCUMENTS

| | | |
|---|---|---|
| DE | 8801758 | 5/1988 |
| DE | 4034796 | 5/1992 |
| DE | 19927897 | 12/2000 |
| DE | 199 45 156 A1 | 3/2001 |
| DE | 10 2004 045 407 | 4/2005 |
| GB | 2 060 821 A | 5/1981 |
| WO | 9812381 A1 | 3/1998 |

* cited by examiner

EXPANDER ROLLER

CROSS REFERENCE TO RELATED APPLICATIONS

This is a continuation of PCT application No. PCT/EP2006/064139, entitled "EXPANDER ROLLER", filed Jul. 12, 2006, which is incorporated herein by reference.

BACKGROUND OF THE INVENTION

1. Field of the Invention

This invention relates to an actuator and a roller equipped with at least one such actuator for a web-processing machine. In this case said machine can be in particular a machine for producing a fibrous web, in particular a paper web, paperboard web or tissue web.

2. Description of the Related Art

Many different mechanisms made of levers, spindles or adjustable screwed connections are known for the linear height adjustment of components such as bearings. A disadvantage of said known adjustment devices or actuators is that the adjustment is very complicated because clampings have to be released and/or components cannot be connected to each other rigidly enough and therefore work or vibrate.

In the interest of a rigid, low-vibration connection use has already been made therefore of eccentric bearings because they enable a direct, rigid bearing arrangement for components for example on an eccentric shaft, such bearing arrangement being connected directly to the component in question without joints via a sliding bearing arrangement.

However, a simple eccentric is accompanied by the disadvantage that an adjustment in one plane simultaneously entails a change in a second plane because such a simple eccentric always includes a displacement in a corresponding angular position.

On a roller with adjustable bending known from DE 199 27 897 A, setscrews are provided for the variable setting of the bend.

To guide the web on web-processing machines, provision has been made up to now for arrangements on which in particular guide rollers, regulation rollers and expander rollers are arranged in succession. A disadvantage of these known arrangements are, among other things, their high investment and maintenance costs.

Because of the simple construction of a guide roller, its components are extremely economical. However, it is a disadvantage that the web run can be negatively influenced through compliance of the guide roller.

Expander rollers are used in web-processing machines in order to prevent fold formation or sagging on a running material web by expanding the material web. Also, expander rollers are used to guide apart material webs that are arranged side by side and parallel with each other. Material webs arranged side by side and parallel with each other can be produced by slitting a wide material web for example. Such expander rollers are known for example from DE 199 27 897 A1 and DE 10 2004 045 407 A1.

Expander rollers often include several individually mounted segments which entail a high level of maintenance and are accordingly cost-intensive. The maintenance of such an expander roller generally costs approximately 60% of the new price. Furthermore, the usual expander rollers used hitherto have a very slim construction and an accordingly low load-carrying capacity so that their use as a guide roller is ruled out.

The newest expander roller versions based on high-performance plastics have optimized curvatures. The disadvantage of said versions is however that the constructions in question are not torque-free mounted, meaning that the support of the machine in question, for example a paper machine, is loaded in undesirable manner. In the case of new plants, account must be given to the torques arising, which requires cost-intensive reinforcements. In the case of existing plants, even more expensive auxiliary structures are required.

What is needed in the art is an improved actuator of the type initially referred to, which enables on the one hand a linear adjustment and on the other hand an adjustment of the angular position of the adjustment. In this case said actuator should be suitable in particular as a control mechanism for a rigid, adjustable bearing arrangement. It is thought to use said actuator in particular on a roller for a web-processing machine. In addition it is intended to create an improved roller of the type initially referred to, with which the previously mentioned problems are eliminated. In particular the torques introduced into the support should also be minimized. Finally, the roller in question should also be suitable for performing the functions of several different roller types simultaneously.

SUMMARY OF THE INVENTION

The present invention provides an adjustable actuator with two inter-mounted eccentrics to which is assigned respectively one pivoting device, whereby the two pivoting devices are controllable such that the size of the resulting eccentricity and the position of said resulting eccentricity are adjustable preferably separately from each other.

As a result of said construction it is possible in a constructively simple and reliable manner to effect a linear eccentric adjustment and a pivoting of the eccentric position about an axis of rotation. Such an actuator is suitable in particular for use on a roller for a web-processing machine. By way of corresponding actuators it is thus possible for example to adjust an expander roller etc., meaning in this case that for example the roller curvature can be linearly adjusted and the roller pivoted into the web.

The two pivoting devices can be mounted concentrically.

On an expedient practical embodiment of the inventive actuator, the two pivoting devices includes respectively a pivoting shaft which is coupled to the eccentric in question. In this case the pivoting shafts of the two pivoting devices are mounted advantageously concentrically.

To be able to set the eccentricity starting from a zero position, the eccentricities of the two eccentrics can be identical in size.

The pivoting shafts of the two pivoting devices can be connected respectively to a worm gear to which is assigned a respective worm shaft.

Expediently the worm shafts can be coupled to each other mechanically via a shiftable gear. To clamp the shiftable gear in its center position, it is expedient for the gear wheels for co-directional and counter-directional movement to be engageable simultaneously. When designing the gear it is important to provide the correct tooth number ratios so that the teeth stand in the correct position in both tooth positions for shifting.

If drive motors are assigned to the worm shafts, then the worm shafts can be coupled to each other advantageously via an electronic controller assigned to said drive motors.

The inventive actuator can be used advantageously in particular within the outer covering of a roller for a web-processing machine for the corresponding loading of the outer covering in particular in the region of the roller ends.

Hence in order to adjust a double eccentric mechanism use is made of two inter-mounted eccentrics to which is assigned a double pivot mechanism which can be mounted concentrically and fastened respectively to one output shaft on an eccentric cam. On this arrangement, counter-directional rotation of the worm shafts results in the eccentrics being displaced by the same amount exactly linearly to each other without any change of angle of the overall eccentricity. If the eccentricity is to be retained but a change of angle of the eccentric position effected, then the eccentrics are rotated in the same direction.

Through a corresponding control arrangement for the corresponding coupling of the eccentric movements, the pivot movement can be decoupled from the eccentric stroke movement. In this case it is possible, using an in particular electronic controller for the worm shaft speeds and for the directions of rotation, to adopt any position from zero to up to one circle diameter, which corresponds to the double eccentric stroke of an eccentric cam. The path up to the desired setting point with regard to the pivot and stroke movement is freely selectable in this case through the speed and the selection of the pivot gear direction. When using worm gears with high transmissions there is often also no need for a brake because in most cases a self-braking of the mechanism already exists through the drive's friction. The actuators can be used to particular advantage within the outer covering of a roller, in particular a roller for a web-processing machine. Through corresponding positioning of the actuators and the bearings in question within the outer covering, the torques introduced into the support are reduced to a minimum in this case.

The present invention also provides a roller for a web-processing machine, said roller having a support core, which is braced in the region of both its ends via a respective bearing arrangement, and an outer covering, which in its axially central region is braced in a radially fixed manner in relation to the support core and in the region of its two ends is braced in a radially displaceable manner in relation to the support core by a respective additional bearing arrangement, whereby the outer covering is adjustable in the region of its two ends respectively by an inventive actuator which can be arranged within the outer covering. In this case the radially extending center plane of respectively the support core bearing arrangement and the outer covering bearing arrangement lies axially within the outer covering.

As the result of this construction, the roller in question is able to perform not only the function of a certain type of roller but also, if required, the functions of at least two different roller types simultaneously. By accordingly omitting one roller, construction space is saved accordingly. A cost-saving construction is generally possible.

As previously mentioned, the combination of at least two functions in one roller is accompanied by the advantage of considerable cost cuts. In particular the function group's construction space is reduced, mesh and felt costs are lowered, and because fewer spare rollers need to be kept in stock the cost of maintenance and the cost of stock-keeping for spare parts are reduced accordingly. Finally, the result is a lower level of product variety, which leads likewise to reduced costs.

In particular the torque channeled into the support is reduced to a minimum in this case, whereby it can be reduced even to zero in the optimum case. The fact that the actuator is also arranged within the outer covering results in a compact adjusting device which enables the forces for the adjustment to be reduced and the forces arising to be contained.

According to a practical embodiment of the inventive roller, the actuators are adjustable or controllable such that the functions of at least one and preferably the functions of at least two of the following types of roller are performed simultaneously with the one roller: expander roller; guide roller; regulation roller, in particular a web run regulation roller or a type of controlled deflection roller; and tension roller.

In this case the actuators can be adjustable or controllable in particular such that respectively the functions of a guide roller and an expander roller, the functions of a guide roller and a tension roller, the functions of a guide roller and a regulation roller, the functions of an expander roller and a regulation roller, the functions of an expander roller and a tension roller or the functions of a tension roller and a regulation roller are performed simultaneously with the one roller.

To minimize static loads and undesirable vibrations, the roller has preferably an outer diameter >280 mm, in particular >300 mm and preferably >320 mm. In this case a stable expanding effect is achieved as the result.

In particular in order to perform the functions of an expander roller, the actuators are advantageously adjustable or controllable at least such that the roller is curved and pivoted into the web.

In particular in order to perform the functions of a guide roller and/or a regulation roller, the actuators are expediently adjustable or controllable at least such that a compliance of the roller due to its own dead weight and/or because of the web tension is compensated at least essentially.

The actuators are adjustable or controllable dependent on the different operating states in the respective installed situations. For example a tension roller can be adjusted via the actuators according to the respective conditions and requirements in the desired manner. The same applies also for the other types of roller.

In particular in order to perform the functions of a web run regulation roller, the actuators are advantageously differently adjustable or controllable at the drive end and at the operator end in order to bring about an inclined position of the roller.

Hence it is possible, through separate adjustment of the end regions of the roller independently of each other, to perform another function, namely that of a regulation roller.

The actuator is advantageously arranged radially between the support core bearing arrangement and the outer covering bearing arrangement.

On a practical embodiment of the inventive roller, the actuator is braced on the support.

As previously mentioned, the two eccentrics are advantageously adjustable jointly and/or separately.

Hence with such an eccentric arrangement, the position of the curvature height or magnitude of curvature and/or the position of the curvature plane can be adjusted in each case separately or jointly or simultaneously.

With a view to as torque-free a bearing arrangement as possible, it is an advantage for the respectively radially extending center planes of the support core bearing arrangement and the outer coating bearing arrangement to coincide at least essentially. Advantageously provision is made therefore for an aligned or symmetrical arrangement of the support core bearings and the outer covering bearings.

A practical embodiment of the inventive roller is characterized in that the support core bearing arrangement and the outer covering bearing arrangement include respectively only one bearing and in that the support core bearing and the outer covering bearing are arranged at least essentially in a common radial plane.

Advantageously it is also possible for the support core bearing arrangement and/or the outer covering bearing arrangement to include respectively two or more bearings.

If the outer covering bearing arrangement includes two or more bearings, then the radially extending center plane of said outer covering bearing arrangement expediently coincides at least essentially with the radially extending center plane of the support core bearing arrangement. If the support core bearing arrangement is formed by only one bearing, then said support core bearing can be arranged at least essentially in the radially extending center plane of the outer covering bearing arrangement.

In principle it is also possible however for the support core bearing arrangement to include two or more bearings. In this case the bearings of the outer covering bearing arrangement and the bearings of the support core bearing arrangement are advantageously arranged respectively symmetrically with regard to a radial plane common to the two bearing arrangements.

If the support core bearing arrangement includes two or more bearings, then the radially extending center plane of said support core bearing arrangement expediently coincides at least essentially with the radially extending center plane of the outer covering bearing arrangement.

If the outer covering bearing arrangement includes only one bearing in this case, then said outer covering bearing can be arranged at least essentially in the radially extending center plane of the support core bearing arrangement.

If the outer covering bearing arrangement also includes two or more bearings, then the bearings of the support core bearing arrangement and the bearings of the outer covering bearing arrangement are again advantageously arranged respectively symmetrically with regard to a radial plane common to both bearing arrangements.

Through the corresponding arrangement of the bearings and/or the actuator there results a very rigid construction which is particularly insensitive to vibrations. Vibrations which arise nevertheless can at least be reduced by suitable damping elements. On a preferred practical embodiment provision is made for example for damping ways between the support core bearing arrangement and the outer covering bearing arrangement. In this case a viscous liquid can be inserted into the hollow space between the support core bearing arrangement and the outer covering bearing arrangement.

It is also possible for example to provide a membrane in the region between the support core bearing arrangement and the outer covering bearing arrangement.

Alternatively or in addition it is an advantage for the roller to be fastened via vibration-damping elements on the support. Alternatively or in addition it can also be fastened in particular via actively damping hydraulic elements on the support.

Due to the small construction space it may be necessary to use small bearings and preferably bearings which unite the bearing function and an angle-compensating function in one. The support core bearing arrangement and/or the outer covering bearing arrangement respectively can include at least one angle-compensating bearing.

In particular in the case of high forces, the support core bearing arrangement and/or the outer covering bearing arrangement can include in particular at least one tapered-roller bearing, cylindrical-roller bearing or spherical-roller bearing which, because they permit no angle adjustment, must be mounted such that an angle adjustability of the outer covering axis and/or the support core axis is guaranteed.

On a practical embodiment of the inventive roller, the support core is rotatable jointly with the outer covering. In this case the outer covering can be non-rotatably connected to the support core.

Also possible in principle, however, are for example such versions on which the support core is non-rotatable about its longitudinal axis.

It is also an advantage in particular for the support core to have, looking in the axial direction, a different cross-sectional shape at least in some sections. In this case the support core can have, in particular at least in some sections, a cross-sectional shape which tapers conically towards its ends.

On the inventive roller the force flow, which is caused by the corresponding construction and the loads arising, is thus transferred as directly as possible and without auxiliary structures between the two bearing arrangements.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
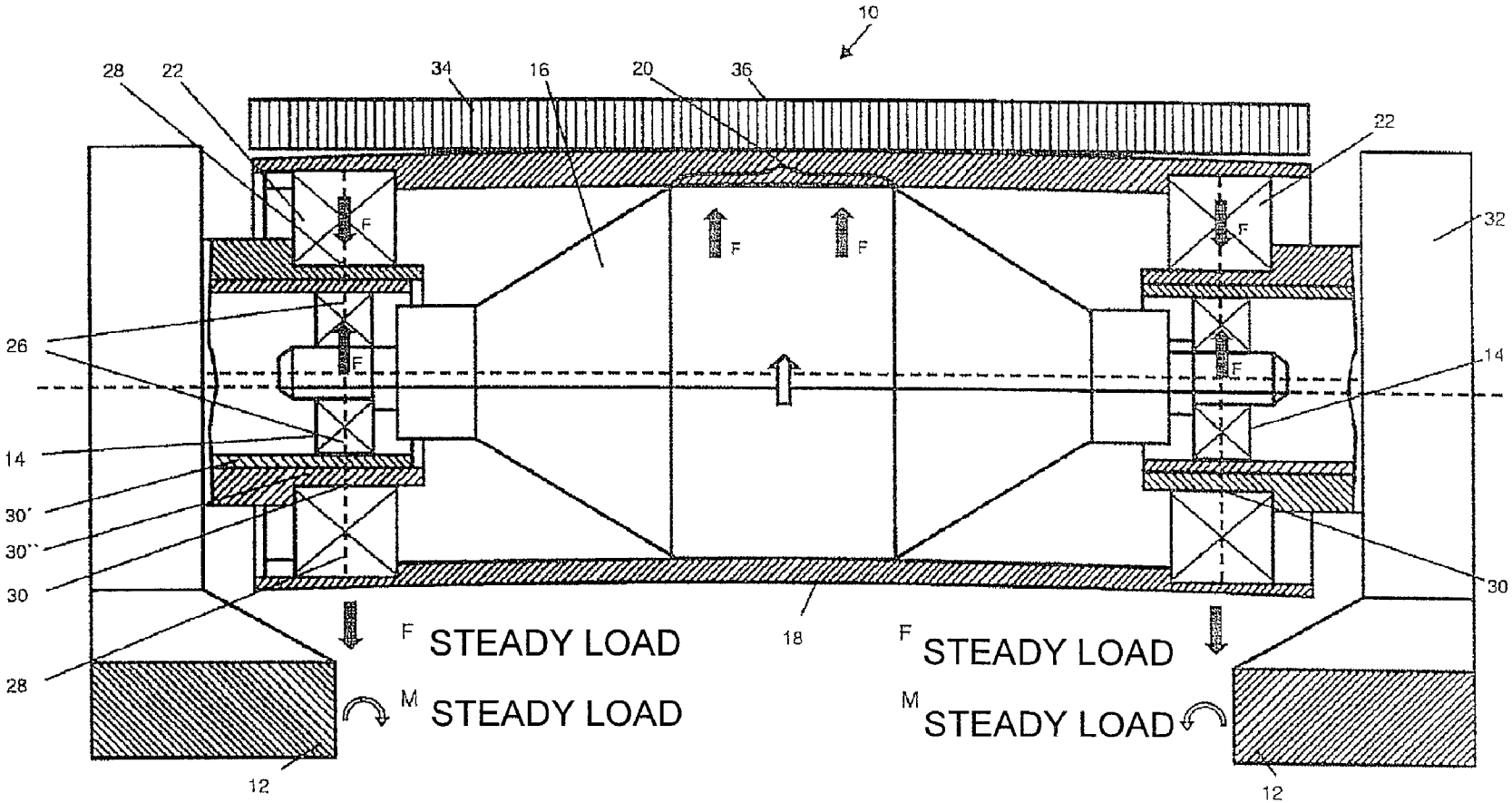
FIG. 1 is a schematic representation in longitudinal section of an inventive roller equipped with inventive actuators and with an assigned support.

Referring now to the drawings, and more particularly to FIG. 1, there is shown FIG. 1 shows in a schematic representation in longitudinal section a roller 10 with an assigned support 12. Said roller 10 can be used in particular on a web-processing machine, in particular a paper machine. In this case said roller can be used as an expander roller, guide roller, regulation roller, in particular a web run regulation roller or a type of controlled deflection roller, and/or as a tension roller. It can simultaneously perform the functions of at least two of the roller types mentioned.

As is evident from FIG. 1, the roller 10 has a support core 16, which is braced in the region of its two ends by way of a respective bearing arrangement 14, and an outer covering 18.

In its axially central region 20 the outer covering 18 is mounted in a radially fixed manner in relation to the support core 16 and in the region of its two ends is braced in a radially displaceable manner in relation to the support core 16 by a respective additional bearing arrangement 22.

As can be seen in FIG. 1, the radially extending center plane 26 and 28 of respectively the support core bearing arrangement 14 and the outer covering bearing arrangement 22 lie within the outer covering.

In the region of its two ends, the outer covering 18 is adjustable respectively by an actuator 30 which is arranged within the outer covering 18 radially between the support core bearing arrangement 14 and the outer covering bearing arrangement 22. Said actuator 30 is braced on the support 12 and is variably adjustable by way of a pivot device 68 (cf. in particular FIG. 5) which includes a pivot gear, in particular a worm gear 32 and is described in more detail in the following.

Also evident from FIG. 1 is a material web 34 which is passed over the roller 10; said web can be for example a paper web, paperboard web or tissue web.

Said material web 34 is accompanied by a corresponding web tension and hence a steady load 36 which results solely in a small tilting torque which is introduced into the support 12.

A respective actuator 30 includes two inter-mounted eccentrics 30', 30" to which is assigned respectively one pivoting device 68, 70 (cf. in particular also FIGS. 2 to 5). In this case the two pivoting devices 68, 70 are controllable such that the size of the resulting eccentricity and the position of said resulting eccentricity are adjustable preferably separately from each other.

The two pivoting devices 68, 70 are concentrically mounted in the case in question. They include respectively one pivoting shaft or eccentric shaft 44', 44" coupled to the eccentric 30', 30" in question, whereby, as is most clearly evident from FIG. 5, said pivoting shafts 44', 44" of the two pivoting devices 68, 70 are concentrically mounted.

The extremities of the two eccentrics 30', 30" are expediently identical in size.

Figure 5:
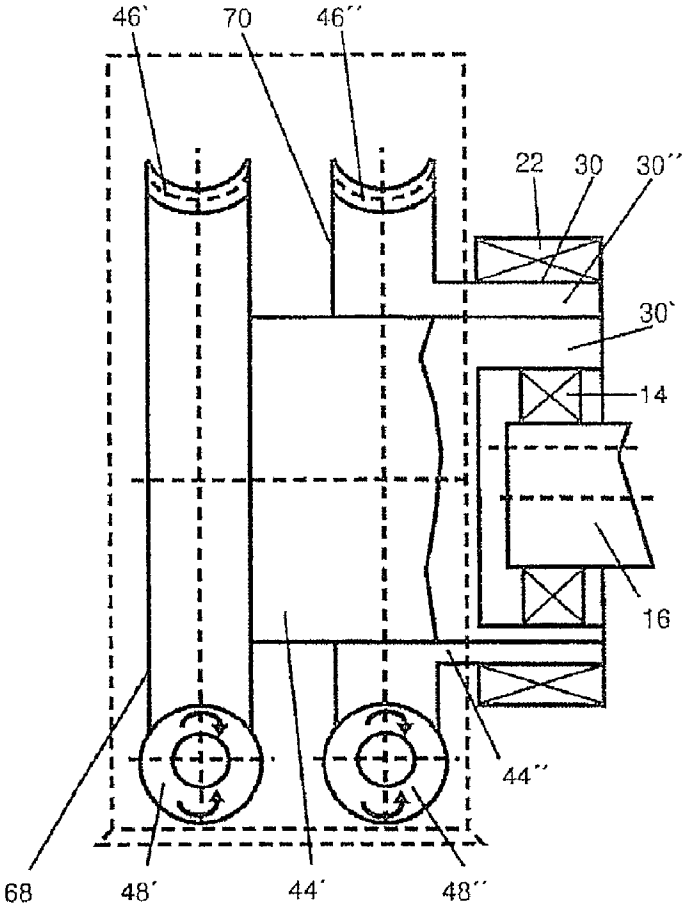
FIG. 5 shows a schematic side view in partial section of the roller end according to FIG. 4.

As is evident in particular from FIG. 5, the pivoting shafts 44', 44" of the two pivoting devices 68, 70 are connected respectively to a worm gear 46', 46" to which is assigned a respective worm shaft 48', 48".

Expediently the worm shafts 48', 48" can be coupled to each other mechanically via a shiftable gear. To clamp the shiftable gear in its center position in this case, the gear wheels for co-directional and counter-directional movement can be engaged simultaneously.

It is also possible however for separate drive motors to be assigned to the worm shafts 48', 48", whereby in this case the worm shafts 48', 48" can be coupled to each other advantageously via an electronic controller assigned to said drive motors.

The actuator 30 thus includes two inter-mounted eccentrics 30', 30" which can be adjusted jointly or separately.

In the state shown in FIG. 1, the roller is curved. For this purpose the support core is displaced by the actuator including the two eccentrics. The force for lifting the support core is introduced in the inner eccentric. The outer covering is curved with the force and braces itself on the outer covering bearing arrangements. Because said bearing arrangements lie in one plane, no torque arises. The precondition for this are pivotable bearings.

For the roller to adopt its non-curved neutral position, the actuator must be adjusted such that the eccentricity of the inner eccentric is displaced by 180° in relation to the eccentricity of the outer eccentric.

In the case in question the bearing arrangements provided are for example self-aligning roller bearings etc. As is evident from FIG. 1, the outer covering bearing arrangement provided on the left-hand roller end is a floating bearing and the outer covering bearing arrangement provided on the right-hand roller end is a fixed bearing. The support tube bearing arrangements are formed respectively by a floating bearing.

Figure 2:
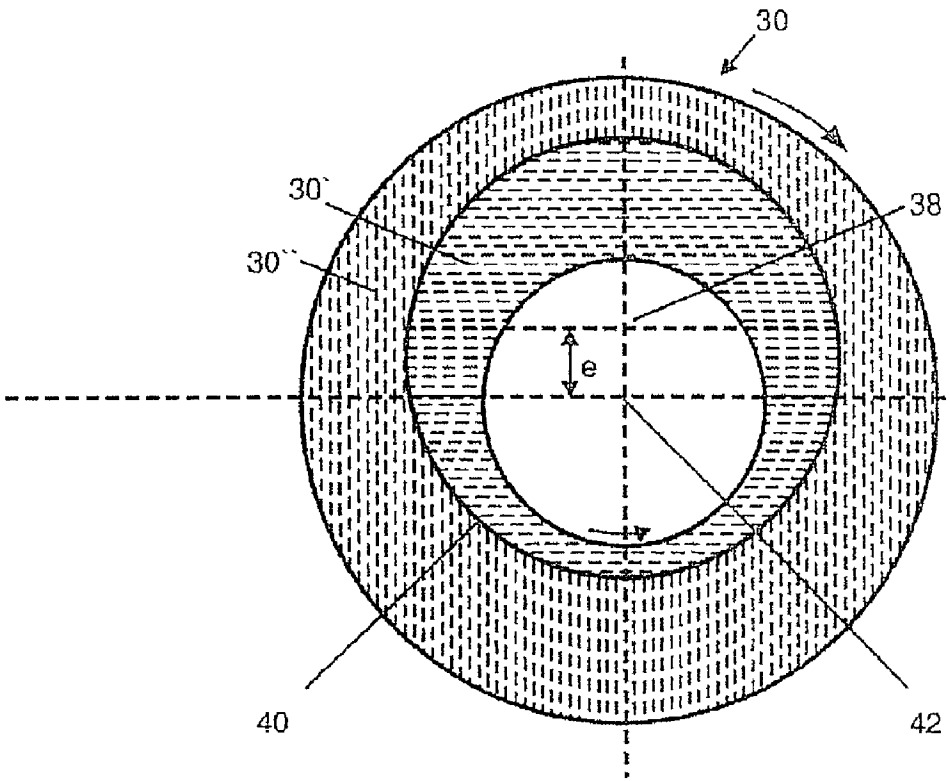
FIG. 2 is a schematic representation in cross section of an actuator, which is used in the roller according to FIG. 1 and includes a double eccentric, of an inventive roller in the zero position.

FIG. 2 shows in a schematic representation in cross section the actuator 30, which includes the two eccentrics 30', 30", in a zero position in which the maximum eccentric of the inner eccentric 30' coincides with the minimum eccentricity of the outer eccentric 30". Hence the axis 38 of the circular cylindrical interface 40 between the two eccentrics 30', 30" is displaced here upwards by an amount "e" in relation to the axis 42 of the support core bearing arrangement 14, thus resulting also in a corresponding positioning of the outer covering bearing arrangement 22 and hence of the roller covering end in question.

Figure 3:
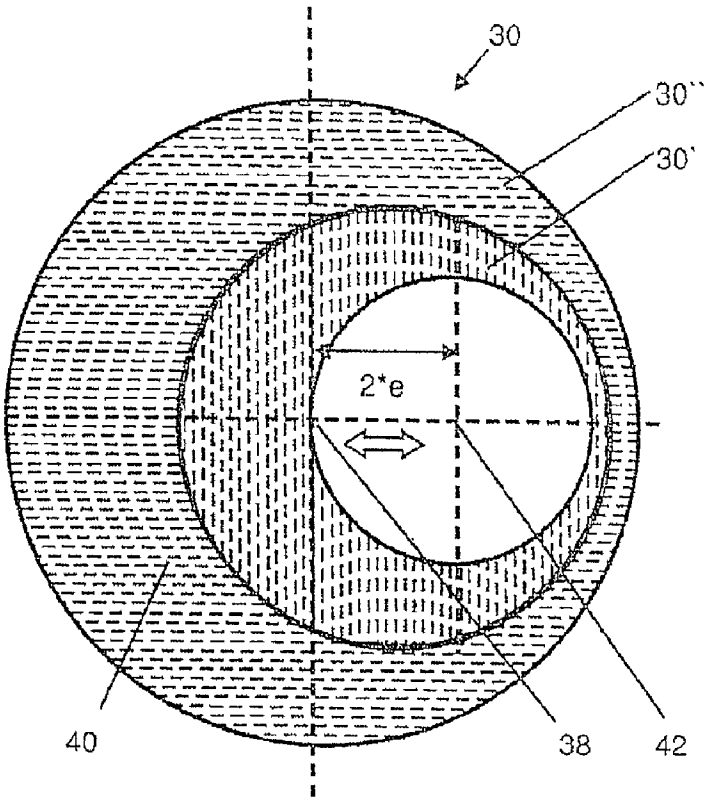
FIG. 3 is a schematic representation in cross section of an actuator, which includes a double eccentric, of an inventive roller in a setting for effecting a maximum displacement.

FIG. 3 shows a representation comparable with FIG. 2, whereby in the case in question the actuator 30 including the two eccentrics 30', 30" is adjusted such that a maximum displacement results. In this case the extremities of the two eccentrics 30', 30" coincide. Accordingly the axis 38 of the circular cylindrical interface 40 between the two eccentrics 30', 30" is displaced here for example to the left by the amount "2e" in relation to the axis 42 of the support core bearing arrangement 14, thus resulting again in a corresponding displacement of the outer covering bearing arrangement 22 and hence of the roller covering end in question.

The extremities of the two eccentrics 30', 30" are therefore, as previously mentioned, of identical size.

Figure 4:
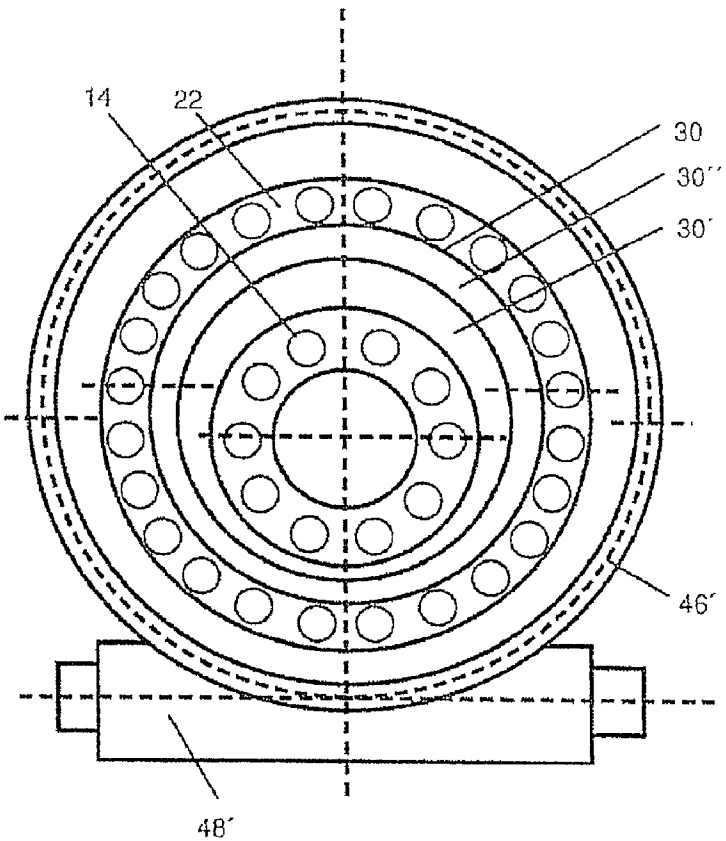
FIG. 4 is a schematic representation in cross section of an end of an inventive roller with an assigned support core bearing arrangement, outer covering bearing arrangement and inventive actuator with a worm gear.

FIG. 4 shows in a schematic representation in cross section a roller end with assigned support core bearing arrangement 14, outer covering bearing arrangement 22 and actuator 30 with the double pivot mechanism, meaning the two pivoting devices 68, 70 (cf. also FIG. 5) for adjusting the two eccentricities 30', 30" of the actuator 30.

In view of the small construction space available, use is made of in particular small bearing arrangements, preferably bearings, for example self-aligning bearings, which unite the bearing function and the angle-compensating function in one. For higher forces, provision can be made for tapered-roller bearings, cylindrical-roller bearings or spherical-roller bearings (also several). However, said bearings must be mounted such that an angle changeability of the axis of the outer covering 18 and/or the axis of the support core 16 is given.

FIG. 5 shows the roller end in a schematic side view in partial section.

As can be seen from FIGS. 4 and 5, the two eccentrics 30', 30" are connected respectively via the pivoting shaft 44', 44" of the pivoting device 68 or 70 in question to the worm gear 46', 46" in question, to which is assigned a respective worm shaft 48', 48", by way of which the two eccentrics 30', 30" are jointly or separately rotatable.

As is best evident from FIG. 4, turning the eccentrics 30', 30" results in a corresponding adjustment of the eccentricity and position of the roller end in question.

Figure 6:
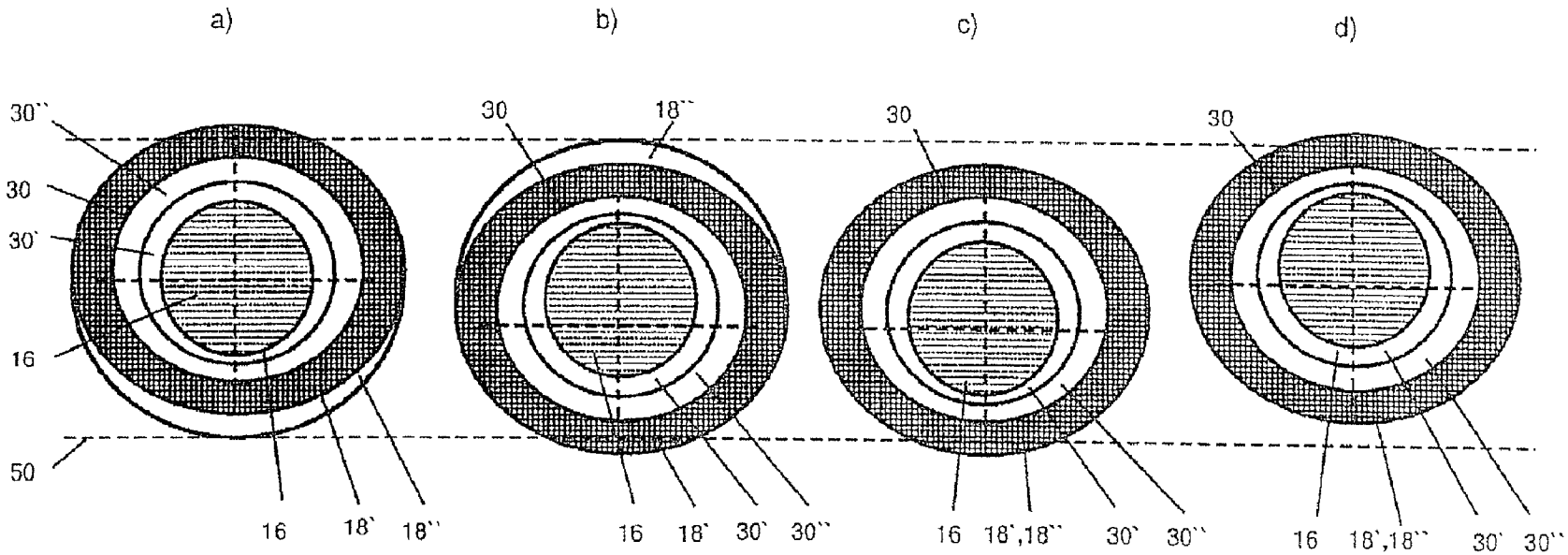
FIG. 6 shows a simplified schematic representation in cross section of an end of an inventive roller with an assigned actuator compared to the outer covering position in the region of the web center at different settings of the actuator.

FIG. 6 shows in a simplified schematic representation in cross section a roller end with an assigned actuator 30 compared to the outer covering position in the region of the web center at different settings of the actuator 30.

In said FIG. 6, the neutral line of the outer covering 18 has the reference number "50". Also evident in the various sections a) to d), in addition to the two eccentrics 30', 30" of the actuator 30, are the support core 16 and the outer covering 18, whereby 18' represents the position of the outer covering 18 at a respective roller end and 18" the position of the outer covering 18 in the web center.

According to FIG. 6*a*), the two eccentrics 30', 30" are adjusted such that the maximum curvature of the outer covering 18 points downwards and the outer covering 18 in the region of the two roller ends is displaced upwards.

According to FIG. 6*b*), the two eccentrics 30', 30" are adjusted such that the maximum curvature of the outer covering 18 points upwards and the outer covering 18 at the roller ends is displaced downwards.

According to FIG. 6*c*), the two eccentrics 30', 30" are adjusted such that no curvature of the covering arises and the outer covering is displaced downwards.

According to FIG. 6*d*), the two eccentrics 30', 30" are adjusted such that no curvature of the covering arises and the outer covering 18 is displaced upwards.

In the two cases mentioned in FIGS. 6*c* and 6*d*, the outer covering 18 is without curvature and oblique relative to the support core 16. As the result it is also possible to realize a guide function with the expander roller.

Of course it is also possible for the outer covering 18 to be simultaneously curved relative to the support core 16 and simultaneously oblique relative to the support core 16.

Figure 7:
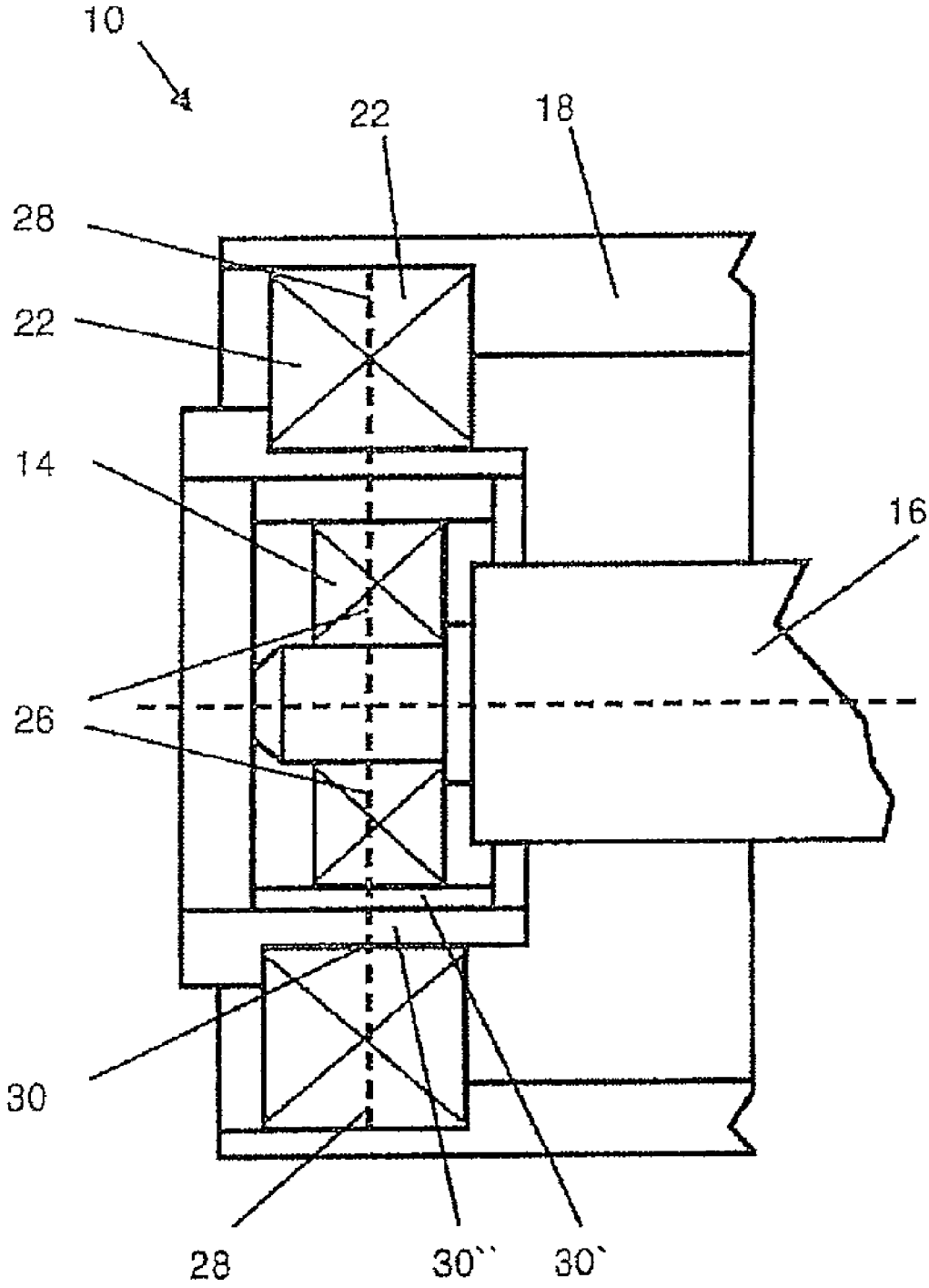
FIG. 7 is a schematic representation in longitudinal section of an end of the inventive roller according to FIG. 1, whereby the support core bearing arrangement and the outer covering bearing arrangement include respectively only one bearing.

FIG. 7 shows in a schematic representation in longitudinal section one end of the roller 10 according to FIG. 1.

In this case the support core bearing arrangement 14 and the outer covering bearing arrangement 22 include respectively only one bearing. In this case the support core bearing and the outer covering bearing are arranged in a common radial plane. The outer covering bearing has larger dimensions than the support core bearing. In this case the respectively radially extending center planes 26 and 28 of the support core bearing arrangement 14 and the outer covering bearing arrangement 22 coincide. Also evident again in said FIG. 7 are the outer covering 18, the support core 16 and the actuator 30.

With some versions of bearings it is possible that the normally more powerful outer tube bearing is converted by smaller rollers etc. to the approximately same load capacity as the inner tube bearing. Hence with a small curvature, the two bearings have an approximately identical minimum load, which results in rolling of the inner tube bearing and the outer tube bearing, meaning that sliding of the rolling bearings and its destructive effect on the bearings are reduced or largely prevented.

The result is a favorable arrangement because direct bracing leads to a reduction of the load on the intermediate sleeves and eccentrics and enables a very rigid low-vibration construction.

Said arrangement can be realized only if the outer diameter of the support core bearing resulting from the roller diameter and the size of the outer covering bearing is still possible for bearings with corresponding load ratings.

Figure 8:
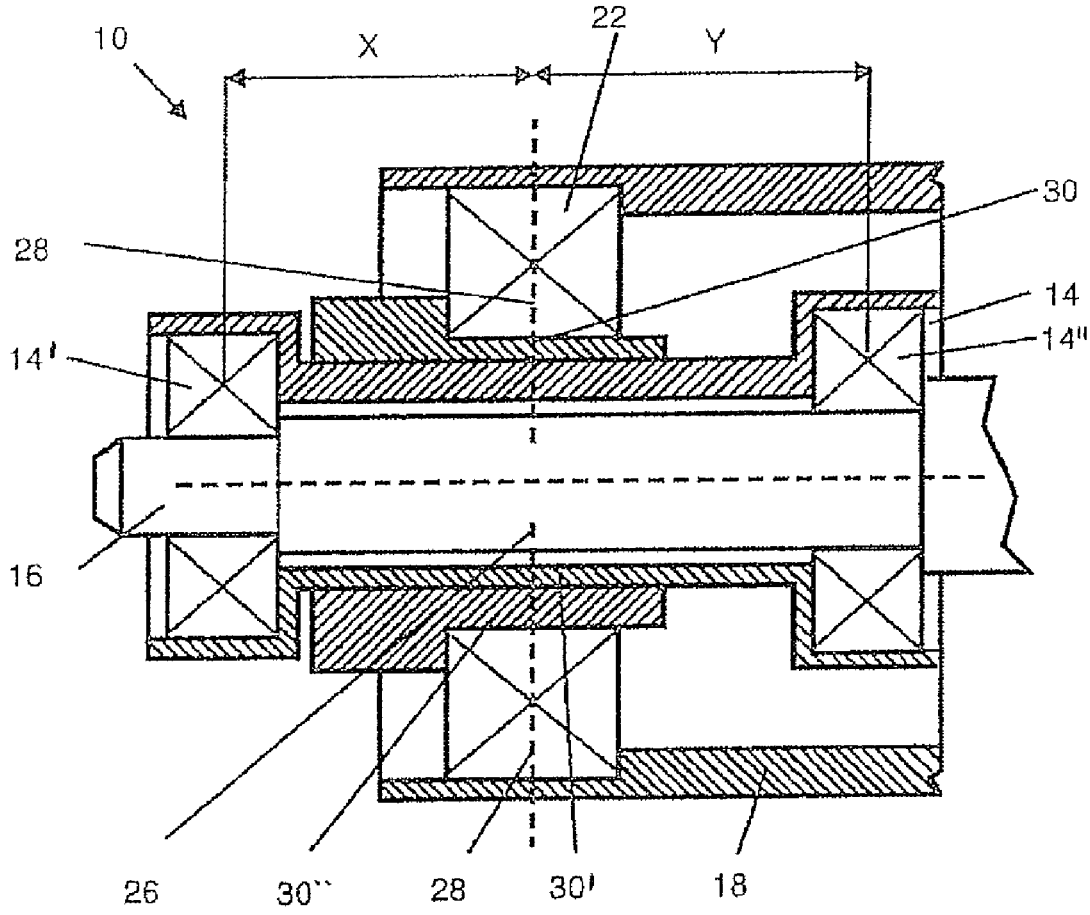
FIG. 8 shows a representation comparable with that from FIG. 7, whereby however the support core bearing arrangement includes two bearings.

FIG. 8 shows a representation comparable with that from FIG. 7, whereby however in the case in question the support core bearing arrangement 14 includes two axially spaced bearings 14', 14". Here too the outer covering bearing arrangement 22 is again formed by only one bearing.

While the right-hand bearing 14" of the support core bearing arrangement 14 is arranged within the outer covering 18, the left-hand bearing 14' lies outside said outer covering 18. However, the center plane 26 of said support core bearing arrangement 14 still lies clearly within the outer covering 18. The bearing of the outer covering bearing arrangement 22 is again larger than the bearings 14', 14" of the support core bearing arrangement 14.

As is evident from FIG. 8, the radially extending center plane 26 of the support core bearing arrangement 14 coincides with the radially extending center plane 28 of the outer covering bearing arrangement 22.

Here too the actuator including the two eccentrics 30', 30" is arranged radially between the support core bearing arrangement, which includes the two bearings 14', 14", and the outer covering bearing arrangement 22.

When using differently sized bearings, the axial distances x and y can differ in order to obtain a load distribution proportional to the load capacity of the bearings.

Given an oblique position of the roller, a corresponding oblique position of the bearings must be enabled in order to obtain a torque-free state. This can be effected either directly by selecting an angle-adjustable bearing or, as is required for a twin arrangement, by way of a seat in the plane of force introduction which permits an oblique position, as is the case for example with a spherical seat.

The arrangement of the outer covering bearing 22 represented in FIG. 8 can also be realized by two or more bearings. Similarly, the number of support core bearings is not limited to two bearings. When using two or more bearings per axis of rotation, the direct bracing and adjustment of the double eccentric bearing arrangement shown by way of example must be effected by accordingly powerful bearing housings which divert internally the force onto two or more bearings and are loaded therefore by an internal torque.

Figure 9:
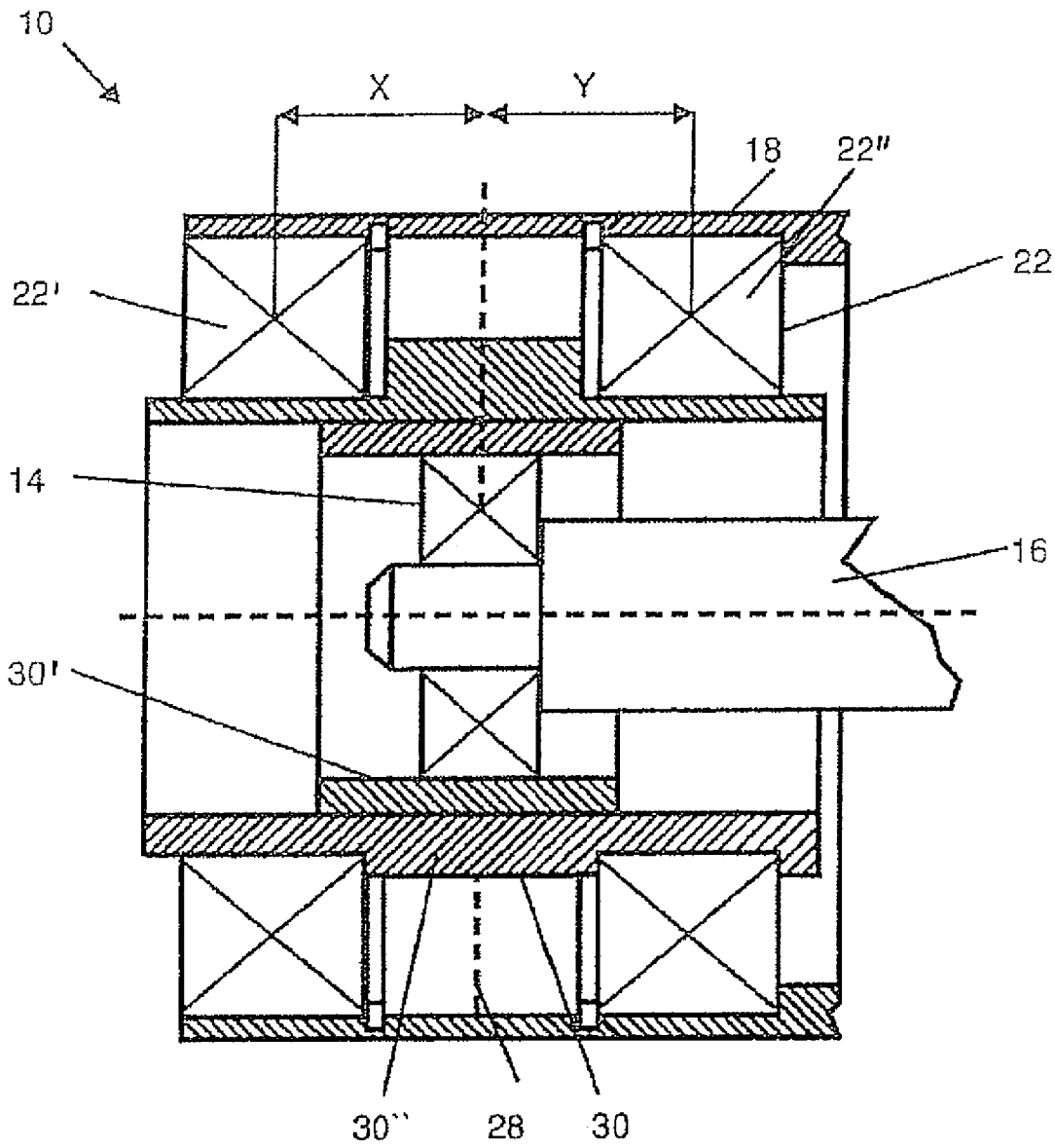
FIG. 9 shows a representation comparable with that from FIG. 7, whereby however the outer covering bearing arrangement includes two bearings.

FIG. 9 shows a representation comparable with that from FIG. 7, whereby however in the case in question the outer covering bearing arrangement 22 includes two bearings 22', 22".

The bearings 22', 22" of the outer coating bearing arrangement 22 are larger in the case in question than the support core bearing arrangement 14, which again is formed by only one bearing.

In the case in question, both the support core bearing arrangement 14 and the outer covering bearing arrangement 22 lie respectively completely within the outer covering 18.

As previously mentioned, the support core bearing arrangement 14 in the case in question includes only one bearing. As is evident from FIG. 9, said support core bearing is arranged in the radially extending center plane 28 of the outer covering bearing arrangement 22. Here too the radially extending center plane 28 of the outer covering bearing arrangement 22 again coincides therefore with the radially extending center plane 26 of the support core bearing arrangement 14.

Also possible in principle are such versions on which both the support core bearing arrangement 14 and the outer covering bearing arrangement 22 include respectively two or more bearings. Such designs with respectively two or more bearings are used in order to achieve a higher overall bearing load capacity and/or they are used in cases in which the radially available construction space is not sufficient for an arrangement of radially nested bearings.

The support core 16 can be rotatable jointly with the outer covering 18. In this case the outer covering 18 can be non-rotatably connected to the support core 16. Also possible in principle, however, are such versions on which the support core 18 is non-rotatable about its longitudinal axis.

As is evident from FIG. 1, the support core 16 can have, looking in the axial direction, a different cross-sectional shape at least in some sections. In the case in question, said support core 16 has, at least in some sections, a cross-sectional shape which tapers conically towards its ends.

Figure 10:
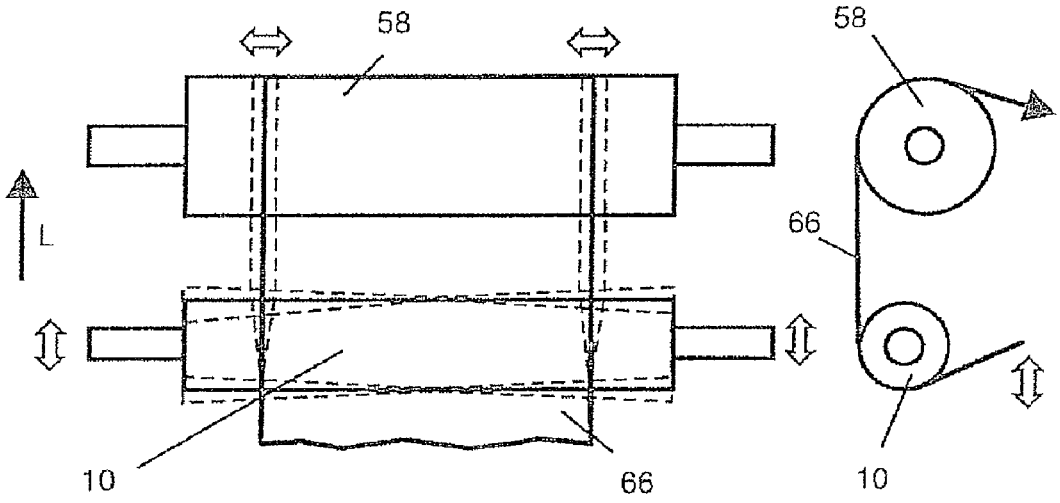
FIG. 10 shows a schematic representation of an inventive roller which is arranged upstream from another roller in the web running direction and simultaneously performs the functions of several different roller types.

FIG. 10 shows in a schematic representation an inventive roller 10 which is arranged upstream from another roller 58 in the web running direction L and simultaneously performs the functions of several different roller types. In this case the left-hand part of FIG. 10 shows a plan view and the right-hand part of said FIG. 10 shows a side view of the arrangement in question.

As said FIG. 10 shows, the inventive roller can be used simultaneously for example as an expander roller and a controlled or regulation roller.

Hence the actuators 30 (cf. also FIGS. 1 to 9) are adjustable or controllable, in particular in order to perform the functions of an expander roller, such that the roller is curved and pivoted into the web while on the other hand they are differently adjustable or controllable in particular in order to perform the functions of a regulation or web run regulation roller at the drive end and at the operator end in order to bring about an inclined position of the roller. Hence it is possible for example for the two actuators to be adjusted at the drive end and at the operator end such that the curvature remains constant but the axis of the support core is adjusted to the inverse control of the actuators at the two roller ends.

Figure 11:
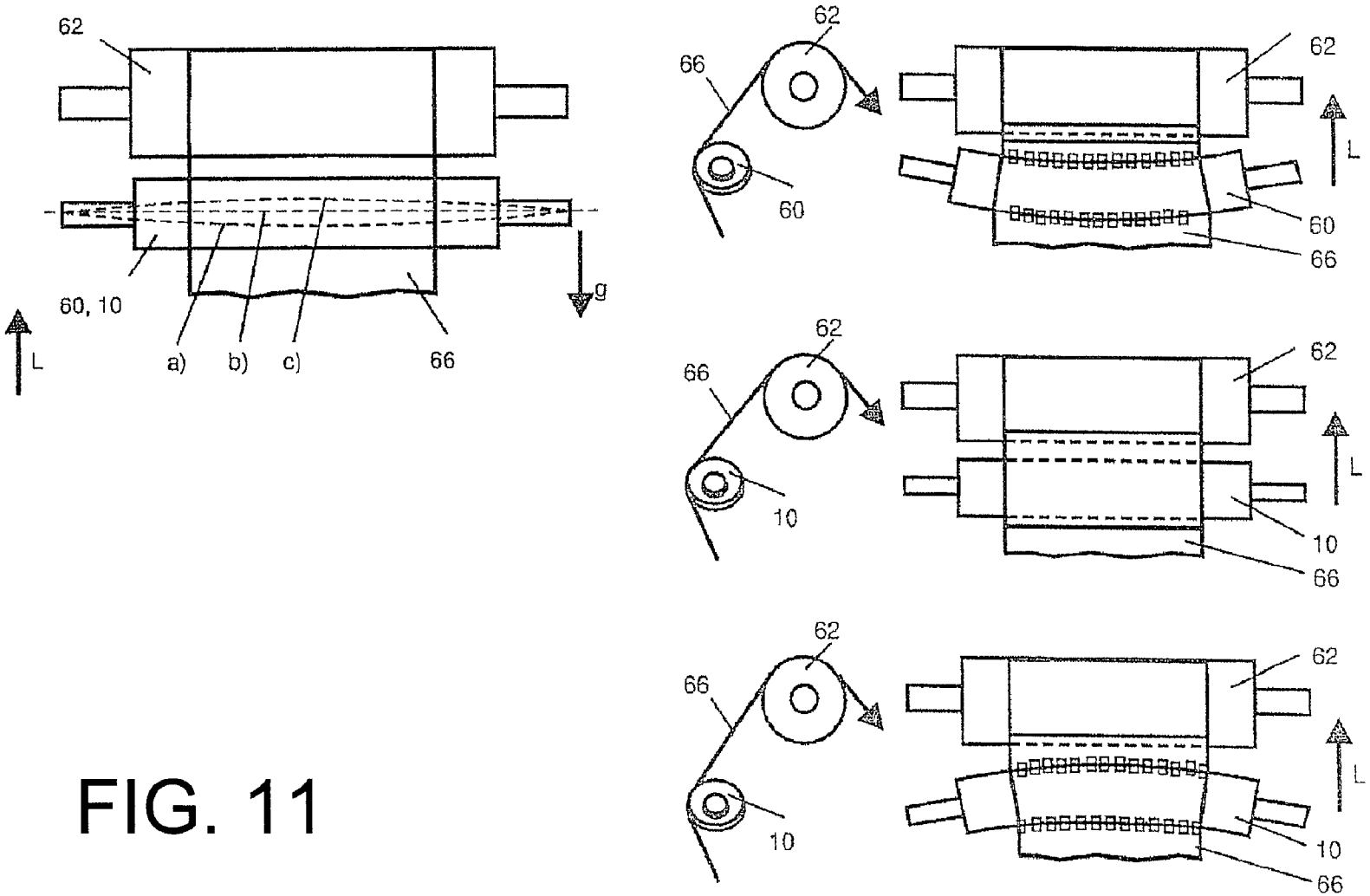
FIG. 11 shows a schematic representation in which two arrangements b) and c), on which respectively an inventive roller performing the functions of several different roller types is arranged upstream from another roller in the web running direction, are compared with an arrangement a) with a conventional guide roller.

FIG. 11 shows in a schematic representation an arrangement a) with a conventional guide roller 60, which is arranged upstream from another roller 62 in the web running direction L. Said conventional arrangement is compared with two arrangements b) and c), in which respectively an inventive roller 10 performing the functions of several different roller types is arranged upstream from another roller 64 in the web running direction.

Evident in the left-hand part of the FIG. 11 is the respective sagging of the rollers 10, 60. The corresponding arrangements a) to c) are shown respectively in a side view in the middle of FIG. 11. The arrangements are shown again in a plan view in the right-hand part of FIG. 11.

As is evident from FIG. 11*a*), the arrangement including the conventional guide roller results in sagging, which is due to the dead weight, and web tension, whereby the paper or web 66 is compressed.

On the other hand, FIG. 11*b*) shows an inventive compensated roller 10 without sagging, which here performs simultaneously for example the functions of a guide roller and a regulation roller. The actuators 30 (cf. also FIGS. 1 to 10) are again also adjustable or controllable at least such that a compliance of the roller 10 due to its own dead weight and/or because of the web tension is compensated at least essentially. The roller 10 is again arranged upstream from another roller 62 in the web running direction L.

Again FIG. 11*c*) also shows an arrangement in which an inventive roller 10 performing the functions of several different roller types is arranged upstream from another roller 62 in the web running direction L. In the case in question, the actuators (cf. again FIGS. 1 to 10) provided at the two roller ends are adjustable or controllable such that the functions of a guide roller and an expander roller are simultaneously performed with the roller 10. As is evident from said FIG. 11, the result in the case in question is a deflection of the roller 10 upwards or towards the web 66.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

ELEMENT LIST

10 Roller
12 Support
14 Support core bearing arrangement
14' Bearing
14" Bearing
16 Support core
18 Outer covering
20 Center region
22 Outer covering bearing arrangement
26 Center plane of the support core bearing arrangement
28 Center plane of the outer covering bearing arrangement
30 Actuator
30' Eccentric
30" Eccentric
32 Pivot gear, worm gear
34 Material web
36 Steady load
38 Axis
40 Circular cylindrical interface
42 Axis of the support core bearing arrangement
44' Pivoting shaft
44" Pivoting shaft
46' Worm gear
46" Worm gear
48' Worm shaft
48" Worm shaft
50 Neutral line of the outer covering
52 Press roller pair
54 Guide roller
56 Expander roller
58 Another roller
60 Guide roller
62 Roller
64 Roller
66 Web
68 Pivoting device
70 Pivoting device
L Web running direction

What is claimed is:

1. An adjustable actuator, comprising:

two inter-mounted eccentrics; and two pivoting devices, each said pivoting device being assigned respectively to one said eccentric, said two pivoting devices being controllable such that a size of a resulting eccentricity and a position of said resulting eccentricity are adjustable, each of said pivoting devices including a pivoting shaft which is respectively coupled to the one eccentric;

two worm gears, each said pivoting shaft being connected to one of said worm gears; and two worm shafts, each said worm shaft being exclusively assigned to a single respective one of said worm gears.

2. The actuator according to claim 1, wherein said two pivoting devices are controllable such that said size of said resulting eccentricity and said position of said resulting eccentricity are adjustable separately from each other.

3. The actuator according to claim 1, wherein said two pivoting devices are mounted concentrically.

4. The actuator of claim 1, wherein said pivoting shafts of said two pivoting devices are mounted concentrically.

5. The actuator of claim 1, wherein a plurality of eccentricities of said two eccentrics are identical in size.

6. The actuator according to claim 1, further including a shiftable gear, wherein said worm shafts are coupled to each other mechanically via said shiftable gear.

7. The actuator according to claim 6, further including a plurality of gear wheels for co-directional and counter-directional movement, said plurality of gear wheels being engageable simultaneously to clamp said shiftable gear in a center position.

8. The actuator according to claim 1, further including a plurality of drive motors and an electronic controller assigned to said plurality of drive motors, wherein separate ones of said plurality of drive motors are assigned to respective ones of said worm shafts and said worm shafts are coupled to each other via said electronic controller.

9. A method of using an adjustable actuator, said method comprising the steps of:

providing that the adjustable actuator includes:

two inter-mounted eccentrics; and two pivoting devices, each said pivoting device being assigned respectively to one said eccentric, said two pivoting devices being controllable such that a size of a resulting eccentricity and a position of said resulting eccentricity are adjustable, each of said pivoting devices including a pivoting shaft which is respectively coupled to the one eccentric;

two worm gears, each said pivoting shaft being connected to one of said worm gears;

two worm shafts, each said worm shaft being exclusively assigned to a single respective one of said worm gears; and positioning the adjustable actuator within an outer covering of a roller for a machine which processes a web of fibrous material for a corresponding loading of said outer covering.

10. The method of claim 9, wherein said roller includes a plurality of roller end regions, said outer covering being correspondingly loaded in said plurality of roller end regions.

11. A roller for a machine which processes a web of fibrous material, said roller comprising:

two support core bearing arrangements;

a support core including two end regions each of which is braced respectively by one of said support core bearing arrangements;

two outer covering bearing arrangements;

an outer covering including an axially central region and two end regions, said outer covering being mounted, in said axially central region, in a radially fixed manner relative to said support core, each of said two end regions of said outer covering being braced in a radially displaceable manner relative to said support core respectively by one of said outer covering bearing arrangements; and two actuators arranged within said outer covering, each of said two end regions of said outer covering being displaceable respectively by one of said actuators, each said actuator being adjustable and including:

two inter-mounted eccentrics; and two pivoting devices, each said pivoting device being assigned respectively to one said eccentric, said two pivoting devices being controllable such that a size of a resulting eccentricity and a position of said resulting eccentricity are adjustable, each of said pivoting devices including a pivoting shaft which is respectively coupled to the one eccentric;

two worm gears, each said pivoting shaft being connected to one of said worm gears; and two worm shafts, each said worm shaft being exclusively assigned to a single respective one of said worm gears.

12. The roller according to claim 11, wherein each said support core bearing arrangement includes a radially extending center plane and each said outer covering bearing arrangement includes a radially extending center plane, said radially extending center planes of said support core bearing arrangements and said outer covering bearing arrangements lying axially within said outer covering.

13. The roller according to claim 11, wherein said actuators are one of adjustable and controllable such that the roller is configured for performing simultaneously a plurality of functions of at least two of an expander roller, a guide roller, a regulation roller, and a tension roller.

14. The roller according to claim 11, wherein said regulation roller is one of a web run regulation roller and a controlled deflection roller.

15. The roller according to claim 11, wherein said actuators are one of adjustable and controllable such that the roller is configured for performing simultaneously a plurality of functions of at least two of an expander roller, a guide roller, a regulation roller, and a tension roller.

16. The roller according to claim 11, wherein the roller has an outer diameter >280 mm.

17. The roller according to claim 16, wherein the roller has an outer diameter >300 mm.

18. The roller according to claim 17, wherein the roller has an outer diameter >320 mm.

19. The roller according to claim 11, wherein said actuators are one of adjustable and controllable such that the roller is curved and pivoted into the web and thereby is configured for performing a plurality of functions of an expander roller.

20. The roller according to claim 11, wherein said actuators are one of adjustable and controllable such that a compliance of the roller at least one of due to a dead weight of the roller and because of the web tension is compensated at least essentially and thereby the roller is configured for performing a plurality of functions of at least one of a guide roller and a regulation roller.

21. The roller according to claim 11, wherein the roller includes a drive end an operator end and said actuators are differently at least one of adjustable and controllable at said drive end and at said operator end in order to bring about an inclined position of the roller, and thereby the roller is configured for performing a plurality of functions of a web run regulation roller.

22. The roller according to claim 11, wherein each said actuator is arranged radially between one said support core bearing arrangement and one said outer covering bearing arrangement.

23. The roller according to claim 11, further including a support, wherein each said actuator is braced on said support.

24. The roller according to claim 11, wherein said two eccentrics are adjustable at least one of jointly and separately.

25. The roller according to claim 11, wherein each said support core bearing arrangement includes a radially extending center plane and each said outer covering bearing arrangement includes a radially extending center plane, each said radially extending center plane of said support core bearing arrangements coinciding at least essentially with a corresponding one said radially extending center plane of said outer covering bearing arrangement.

26. The roller according to claim 11, wherein each said support core bearing arrangement and each said outer covering bearing arrangement includes respectively only one bearing, each said support core bearing arrangement being arranged at least essentially in a common radial plane as a corresponding one said outer covering bearing arrangement.

27. The roller according to claim 11, wherein at least one of a) each said support core bearing arrangement and b) each said outer covering bearing arrangement includes respectively at least two bearings.

28. The roller according to claim 27, wherein each said support core bearing arrangement includes at least two said bearings, a radially extending center plane of each said support core bearing arrangement coinciding at least essentially with a radially extending center plane of a corresponding said outer covering bearing arrangement.

29. The roller according to claim 28, wherein each said outer covering bearing arrangement includes only one said bearing, said bearing of said outer covering bearing arrangement being arranged at least essentially in a corresponding said radially extending center plane of said support core bearing arrangement.

30. The roller according to claim 28, wherein each said outer covering bearing arrangement includes at least two said bearings.

31. The roller according to claim 30, wherein said bearings of each said support core bearing arrangement and said bearings of each said outer covering bearing arrangements are arranged respectively symmetrically with regard to a radial plane common to corresponding ones of said support core bearing arrangements and said outer covering bearing arrangements.

32. The roller according to claim 11, wherein each said outer covering bearing arrangement includes at least two bearings, wherein each said support core bearing arrangement includes a radially extending center plane and each said outer covering bearing arrangement includes a radially extending center plane, each said radially extending center plane of said support core bearing arrangements coinciding at least essentially with a corresponding one of said radially extending center planes of said outer covering bearing arrangements, each said support core bearing arrangement being arranged at least essentially in a common radial plane as a corresponding one of said outer covering bearing arrangements.

33. The roller according to claim 32, wherein each said support core bearing arrangement includes only one bearing, each said support core bearing arrangement being arranged at least essentially in a corresponding one of said radially extending center planes of said outer covering bearing arrangements.

34. The roller according to claim 32, wherein each said support core bearing arrangement includes at least two bearings.

35. The roller according to claim 34, wherein said bearings of each said outer covering bearing arrangement and said bearings of each said support core bearing arrangement are arranged respectively symmetrically with regard to a radial plane common to corresponding ones of said support core bearing arrangements and said outer covering bearing arrangements.

36. The roller according to claim 11, further including a damping device between a respective said support core bearing arrangement and a respective said outer covering bearing arrangement.

37. The roller according to claim 36, further including a viscous liquid, each said support core bearing arrangement and a corresponding said outer covering bearing arrangement defining a hollow space therebetween, said viscous liquid being in said hollow space.

38. The roller according to claim 36, further including a membrane, each said support core bearing arrangement and a corresponding said outer covering bearing arrangement defining a region therebetween, said membrane being in said region.

39. The roller according to claim 11, further including a support and a plurality of vibration-damping elements, the roller being fastened via said plurality of vibration-damping elements on said support.

40. The roller according to claim 11, further including a support and a plurality of actively damping hydraulic elements, the roller being fastened via said plurality of actively damping hydraulic elements on said support.

41. The roller according to claim 11, wherein at least one of a) each said support core bearing arrangement and b) each said outer covering bearing arrangement includes respectively one angle-compensating bearing.

42. The roller according to claim 11, wherein at least one of a) each said support core bearing arrangement and b) each said outer covering bearing arrangement includes respectively at least one self-aligning bearing.

43. The roller according to claim 11, wherein at least one of a) each said support core bearing arrangement and b) each said outer covering bearing arrangement includes respectively one of at least one tapered-roller bearing, at least one cylindrical-roller bearing, and at least one spherical-roller bearing.

44. The roller according to claim 11, wherein said support core is rotatable via said support core bearing arrangements about a longitudinal axis of said support core.

45. The roller according to claim 44, wherein said support core is rotatable jointly with said outer covering.

46. The roller according to claim 44, wherein said outer covering is non-rotatably connected to said support core.

47. The roller according to claim 11, wherein said support core is non-rotatable about a longitudinal axis of said support core.

48. The roller according to claim 11, wherein said support core has, in an axial direction of said support core, a different cross-sectional shape at least in some sections of said support core.

49. The roller according to claim 48, wherein said support core includes a plurality of ends and has, at least in some sections of said support core, a cross-sectional shape which tapers conically towards said plurality of ends.

* * * * *